US005687244A

United States Patent [19]

Untersander

[11] Patent Number: 5,687,244

[45] Date of Patent: Nov. 11, 1997

[54] BONE CONDUCTION SPEAKER AND MOUNTING SYSTEM

[75] Inventor: Peter Untersander, Ecoteaux, Switzerland

[73] Assignee: Stanton Magnetics, Inc., Plainview, N.Y.

[21] Appl. No.: 621,711

[22] Filed: Mar. 28, 1996

[51] Int. Cl.[6] ..... H04R 25/00

[52] U.S. Cl. ..... 381/151; 381/68.3

[58] Field of Search ..... 381/68, 68.3, 151, 381/231, 205, 68.5, 183, 187; 600/25; 607/56, 57; 455/100, 350, 344, 66; 224/247, 255, 265, 623, 624, 930; 24/3.12; 206/806; 128/715, 773, 639; 446/26, 28

[56] References Cited

U.S. PATENT DOCUMENTS 2,482,044 9/1949 Vernier ..... 381/68.3

*Primary Examiner*—Huyen D. Le

*Attorney, Agent, or Firm*—Kane, Dalsimer, Sullivan, Kurucz, Levy, Eisele and Richard, LLP

[57] ABSTRACT

A bone conduction speaker and mounting system allows a person to perceive audible sounds, such as music, through his sense of touch. A bone conduction speaker or transducer is mounted against a person's body, preferably against the sternum. An audio signal is fed to the bone conduction speaker or transducer which converts the audio signal to vibrations. The bone conduction speaker or transducer transmits the vibrations to the person's rib-cage which will then resonate in synchronism with the input audio signal. The audio signal may also be simultaneously fed to regular audio speakers to allow a person to hear as well as feel the audible sounds or music.

6 Claims, 4 Drawing Sheets

BONE CONDUCTION SPEAKER AND MOUNTING SYSTEM

BACKGROUND OF THE INVENTION

1. Field of the Invention

This invention pertains to a bone conduction speaker and mounting system and, more particularly, to a system having a bone conduction speaker or transducer for converting audio electrical signals into vibrations which are transmitted into a person's body to allow a person to feel audible sounds.

2. Description of the Prior Art

Audible sounds are generally perceived by a person's sense of hearing but can also be perceived by a person's sense of touch depending on the environment. A person will always sense the audible sounds through his sense of hearing unless he is deaf. If the audible sounds are loud enough, such as music in a night club or rock concert, a person's body will feel the amplified audible sounds or music in his body through his sense of touch.

Sound transducers have been used as bone conduction microphones that pick up the vibrations of a person's bones corresponding to the sounds produced by the vocal cords of the person such as in U.S. Pat. Nos. 5,054,079 for "Bone Conduction Microphone with Mounting Means" or 5,163,093 for "Microphone Mounting for a Person's Neck". Transducers similar to the ones used in the above patents can also be used in the reverse, i.e., to induce vibrations in a person's body from an electrical audio signal. These transducers or bone conduction speakers will allow a person to feel the music through his sense of touch as well as hear the music through his sense of hearing.

The bone conduction speaker can be positioned above a persons neck like the microphones in the aforementioned patents but the resulting sensation will be hearing and not feeling. If the vibrations from the bone conduction speaker cause the cranium to vibrate, the cranium's vibrations would cause various parts of a person's ears to vibrate. Thus, a hearing sensation would occur in the person. In addition, the neck consists of soft muscle tissue and fat that may dampen or hinder transmission of the vibrations from the transducer or bone conduction speaker to the cranium.

Therefore, in order to alleviate these problems, an objective of the present invention is to provide a bone conduction speaker and mounting system which will allow a person to feel audible sounds.

Another objective of the present invention is to provide a bone conduction speaker and mounting system where the bone conduction speaker vibrates in an audible frequency range that will allow a person to feel the vibrations that would have been felt if the audible sounds were amplified to such a level where the audible sounds could be felt by a person's body.

Another objective the present invention is to provide a bone conduction speaker and mounting system that is positioned against a person's sternum so that the vibrations from the bone conduction speaker are transmitted to the person's rib cage causing the rib cage to resonate in synchronism with the vibrations and the audio signal.

Another objective of the present invention is to provide a bone conduction speaker and mounting system with a mounting means that will position the bone conduction speaker against a person's body and dampen any extraneous vibrations created by movement of the person or of the connecting cable.

Another objective of the present invention is to provide a bone conduction speaker and mounting system that can be used by a disc-jockey to be able to feel and to cue up another music source while listening to and cuing up other music sources through headphones connected to his two ears.

Another objective of the present invention is to provide a bone conduction speaker and mounting system that can be used to enable profoundly deaf people to obtain awareness of the surrounding audible environment.

Another objective of the present invention is to provide a bone conduction speaker and mounting system that can be used by a person listening to audible sounds to also feel the audible sounds such as when listening to music, watching a movie or playing a video game.

SUMMARY OF TEE INVENTION

The above and other beneficial objects are obtained in accordance with the present invention by providing a bone conduction speaker and mounting system which can be used to allow a person to perceive audible sounds, such as music, through his sense of touch. A transducer is mounted against a person's body, preferably against the sternum. An audio signal is fed to the transducer which converts the audio signal to vibrations. The transducer transmits the vibrations to the person's rib-cage which will then resonate in synchronism with the input audio signal. The audio signal may also be simultaneously fed to regular audio speakers to allow a person to hear as well as feel the audible sounds or music.

BRIEF DESCRIPTION OF TEE DRAWINGS

DETAILED DESCRIPTION OF TEE PREFERRED EMBODIMENTS

The aforementioned figures illustrate a bone conduction speaker and mounting means 10 where identical numerals in each figure represent identical elements.

Figure 1:
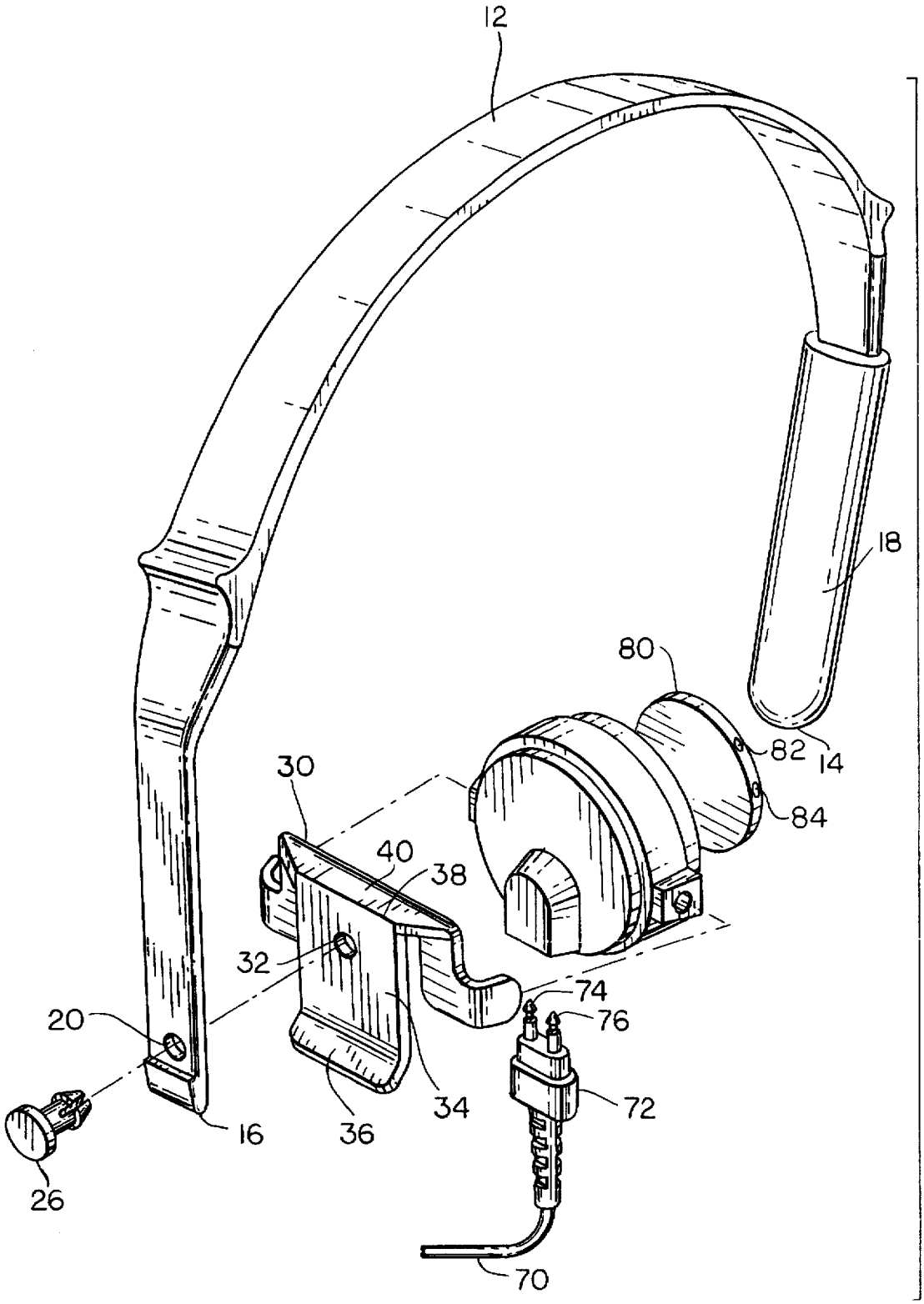
FIG. 1 shows an exploded view of a bone conduction speaker and mounting means.
Figure 2:
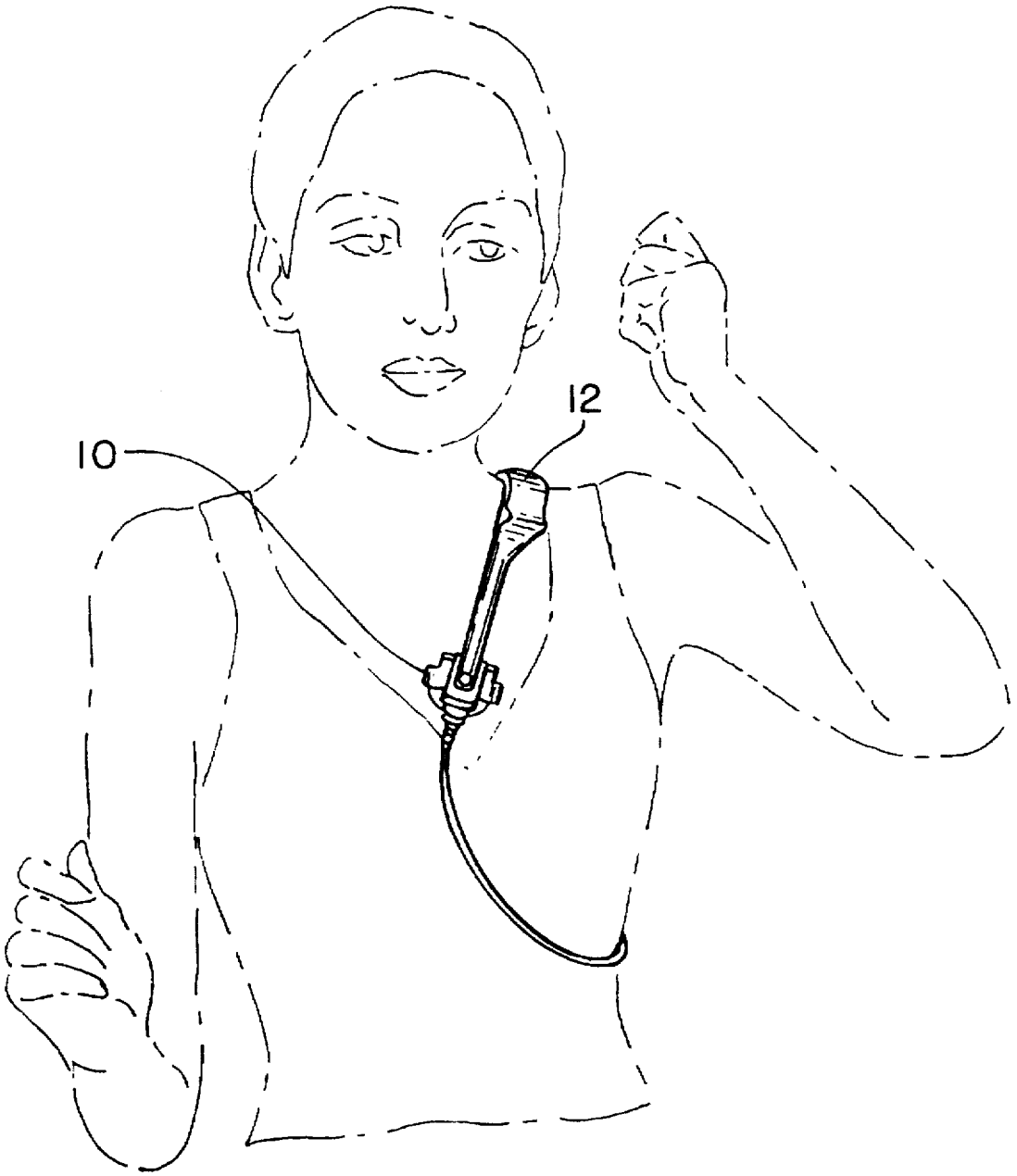
FIG. 2 illustrates an embodiment of how a bone conduction speaker and mounting means is positioned on a person.

As illustrated in FIG. 1, the bone conduction speaker and mounting system 10 includes a band 12 which has an end 14 and an end 16. Band 12 can be made of any material that is flexible enough to allow band 12 to fit over a person's shoulder as shown in FIG. 2. Padding 18 covers end 14 of band 12. Padding 18 should provide a non-slip surface, which will prevent band 12 from moving, and, thus, can be made of many materials such as neoprene tubing.

Band 12 is connected to clip 30 at end 16 of band 12. End 16 has a hole 20. Clip 30 has hole 32 located in the center of back 34. When holes 20 and 32 are lined up, plug 26 is inserted through holes 20 and 32 and, thus, connects band 12 to clip 30. Plug 26 can be of any design but should allow clip 30 to rotate around plug 26 when plug 26 has been inserted through holes 20 and 32. Plug 26 allows the bone conduction speaker 80 to have one axis of rotation.

In addition to being able to be mounted on band 12, clip 30 is shaped to be able to mount on belt 90 as shown in FIG.

3. Belt 90 should be flexible and can be made out of an elastic woven material. Belt 90 can be constructed in a number of ways. Belt 90 can be adjustable or can be one size but belt 90 should be large enough to go over a person's shoulder and across a person's sternum. In addition, belt 90 can be connected to a number of places on either side of the person. For example, belt 90 can be constructed to connect to the waist of a person's pants or to a person's belt.

Clip 30 has a back 34 and a front left arm 42 and front right arm 44 which are designed to slip over opposite sides of belt 90. The bottom end 36 of back 34 slopes away from back 34 to allow clip 30 to easily slip over one side of belt 90. The top end 38 of back 34 is connected to top surface 40. Top surface 40 perpendicularly extends away from back 34 in a direction opposite to the direction in which bottom end 34 slopes away from back 34. In addition, top surface 40 extends beyond the left and right sides of back 34 to front left arm 42 and to front right arm 44. Front left arm 42 and front right arm 44 extend downwards from top surface 40 and parallel to back 34. Front left arm 42 and front right arm 44 are designed to slip over the side of belt 90 opposite the side over which back 34 slips.

Clip 30 holds retaining ring 60 by means of pivot rods 50, 56. Front left arm 42 is L shaped where the bottom portion of the L extends away from back 34 to side 46. Tab 48 perpendicularly extends away from side 46 in a direction opposite to the direction in which bottom end 34 slopes away from back 34. Pivot rod 50 perpendicularly extends inward from the center of tab 48 towards the center of clip 30. Front left arm 44 is also L shaped where the bottom portion of the L extends away from back 34 to side 52. Tab 54 perpendicularly extends away from side 52 in a direction opposite to the direction in which bottom end 34 slopes away from back 34. Pivot rod 56 perpendicularly extends inward from the center of tab 54 towards the center of clip 30. Clip 30 is made of a flexible material to allow pivot rods 50, 56 to slip around the sides of retaining ring 60 and into holes 61, 62 respectively. Pivot rods 50, 56 allow bone conduction speaker 80 to have a second axis of rotation.

Retaining ring 60 is designed to hold bone conduction speaker 80. Retaining ring 60 has a front face 63 which has a recess 64. Bone conduction speaker 80 slips into recess 64. Bone conduction speaker 80 has two holes 82, 84 which respectively line up with holes 66, 68 in retaining ring 60. Cable 70 has plug 72 which has two prongs 74, 76. Prongs 74, 76 slip through holes 66, 68 of retaining ring 60 and into holes 82, 84 of bone conduction speaker 80 and, thus, hold bone conduction speaker 80 in retaining ring 60. Plug 72 is preferably an IEC90 polarized 90 degree plug. Cable 70 runs from plug 72 to the electronics which provide the input audio signal that drives bone conduction speaker 80.

Bone conduction speaker and mounting means 10 basically operates by causing a person's bones to vibrate in synchronism with an audio signal. Bone conduction speaker 80 is a transducer that converts an input audio signal into vibrations that are felt by a person's body. When bone conduction speaker 80 is driven hard enough, the vibrations from bone conduction speaker 80 will cause a person's bones to vibrate allowing the person to feel the audible sounds being transmitted by the audio signal. A person can generally feel audible sounds in a certain frequency range. Even though experts will debate what the exact upper and lower limits of this frequency range are, a person's body is capable of feeling audible sounds in a frequency range of about 4 Hz to 1000 Hz. Thus, the bone conduction speaker 80 should be a transducer that will have a response in this frequency range.

The transducer of bone conduction speaker 80 should preferably be a miniaturized inertial transducer with a response of 250 Hz to 7,000 Hz which comfortably spans the range of audible sounds that can be felt by a person's body. In addition, depending on the construction of the transducer and the electronics that drives the transducer, the upper or lower limits of the range may be adjusted to maximize the effect or to better use the power supply driving the electronics which provide the audio input signal. The transducer response, however, should be as large as possible and the input audio signal should not be filtered in order to allow a person's body to feel a wider range of vibrations and, thus, wider range of audible sounds from bone conduction speaker 80.

The positioning of bone conduction speaker 80 on a person's body can also affect how the body feels the vibrations created by the bone conduction speaker 80. Bone conduction speaker 80 can be placed anywhere on a person's body. The vibrations transmitted by bone conduction speaker 80 into a person's body will be better felt if bone conduction speaker 80 is held against the sternum of a person's chest. A person's rib cage is the most elastic structure of the human skeleton and, therefore, will vibrate in synchronism with the vibrations of bone conduction speaker 80 better than any other part of the body.

Figure 3:
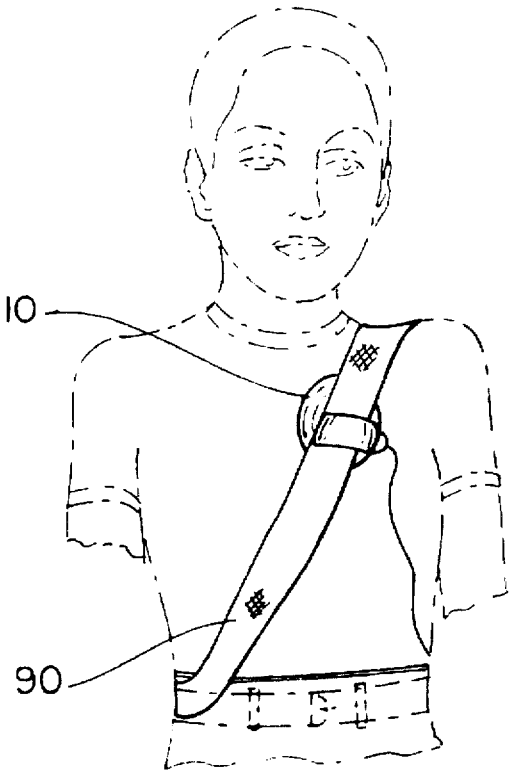
FIG. 3 illustrates another embodiment of how a bone conduction speaker and mounting means is positioned on a person.
Figure 4:
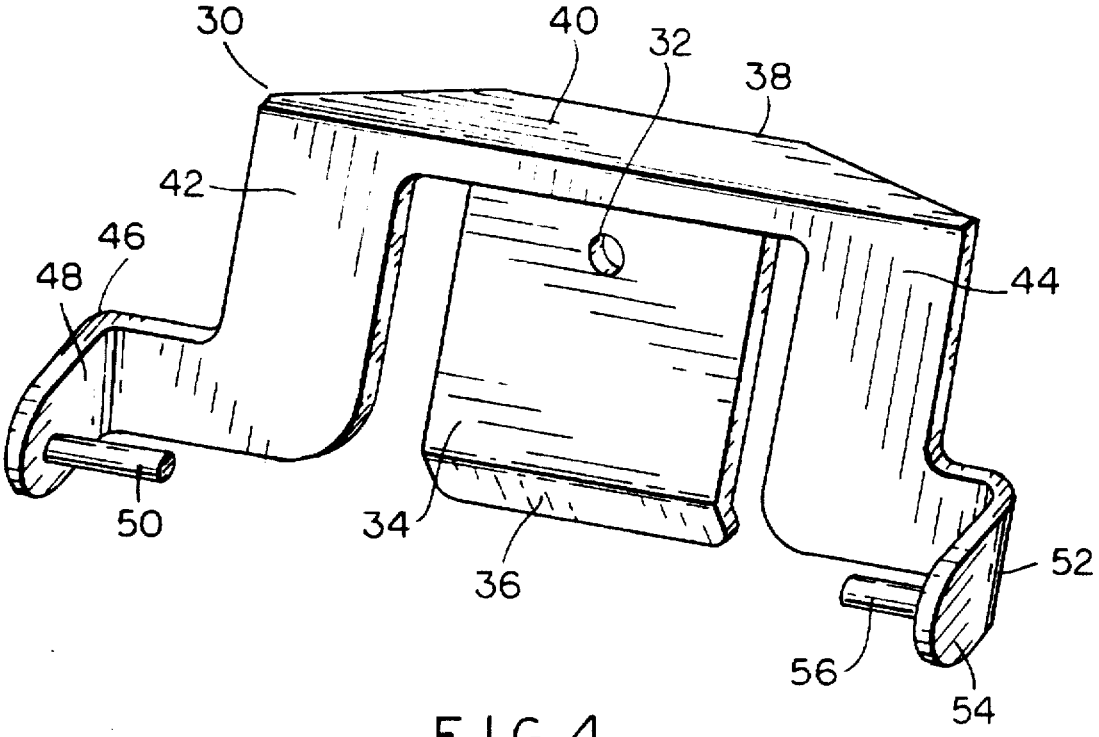
FIG. 4 is a front view of the clip of a bone conduction speaker and mounting means.
Figure 5:
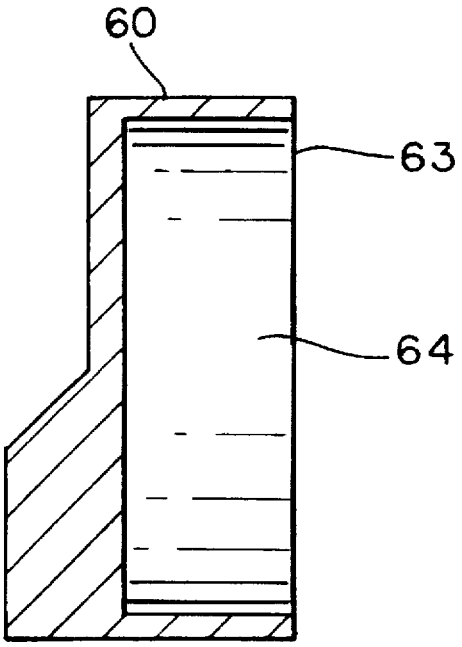
FIG. 5 is a side view of the retaining ring of a bone conduction speaker and mounting means.
Figure 6:
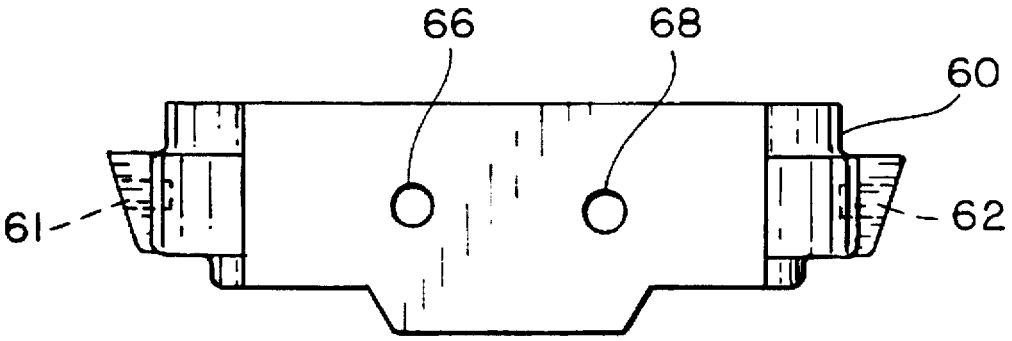
FIG. 6 is a bottom view of the retaining ring shown in FIG. 5.

FIGS. 2 and 3 illustrate how bone conduction and mounting means 10 can be used to position bone conduction speaker 80 against a person's sternum. If band 12 is used, band 12 is slipped over a person's shoulder as shown in FIG. 2 or if belt 90 is used, belt 90 is placed over a person's shoulder as shown in FIG. 3 so that in both cases, bone conduction speaker 80 is positioned against the sternum. When an audio signal is fed to bone conduction speaker 80, bone conduction speaker 80 will vibrate in synchronism with the audio signal and will cause the person's rib cage to resonate. The vibrations of the bone conduction speaker 80 are transmitted directly to the sternum and rib cage and are not dampened by human tissue as would happen if bone conduction speaker 80 was placed on a person's stomach or neck.

The present invention holds bone conduction speaker 80 against the sternum with a definite pressure but also allows bone conduction speaker 80 to adjust to the surface variations of each person's sternum. Both band 12 and belt 90 allow bone conduction speaker 80 to move back and forth from the person's sternum while, as previously mentioned, plug 26 and pivot rods 50, 56 allow the bone conduction speaker 80 to rotate in two different directions. Thus, both band 12 and belt 90 in conjunction with clip 30 will hold the bone conduction speaker 80 against a person's body with a definite pressure, will help to dampen any extraneous vibrations created by movement of the person or of the connecting cable and will help bone conduction speaker 80 to lie flat against said person's sternum. The vibrations from bone conduction speaker 80 can then be transmitted directly to the person's rib cage allowing a person, who is listening to an audio signal, to also feel the audio signal or allowing a person, who is deaf, to be able to feel the audible sounds as if he were actually hearing the audible sounds.

The present invention can be connected to any audio source and, therefore, has a number of applications. A disc-jockey can use the present invention to feel and cue up a third music source while listening to two other music sources in his two ears. A deaf person can use the present invention to gain an awareness of his audible environment, which he can not hear, or to feel the beat of some music, which he can not hear, so he can dance to the music. A person listening to a portable stereo, watching television or a movie or playing a video game can use the present invention to feel as well as hear the music or sounds, thus, adding to the listening experience. Obviously numerous modifications may be made to this invention without departing from its scope as defined in the appended claims.

I claim:

1. A bone conduction speaker and mounting system for allowing a person to feel an audible sound comprising:

a transducer for converting an electrical audio input signal into vibrations that vibrate in synchronism with the audio input signal, and mounting means for positioning said transducer against a person's sternum so that said transducer lies flat against said sternum with enough pressure and with enough dampening to allow said vibrations from said transducer to be transmitted to the person's rib cage without interference from any movements from said person and to cause said rib cage to resonate in synchronism with said vibrations from said transducer, said mounting means comprising:

a retaining ring which holds said transducer and which has two holes on opposite sides of said retaining ring, and a clip which has a top, a back and two front arms on either side of said clip where said back extends downwardly from said top, where said two front arms extend downwardly from said top and parallel to said back, and where said two front arms have pivot rods that slip into said holes on said opposite sides of said retaining ring so that said retaining ring can rotate on said pivot rods and can better adjust itself to be able to lie flat against said person's sternum;

a semi-circular band which has a first end, a second end and a curved section between the two ends and which is flexible and large enough to slip over a person's shoulder so that said first end will be positioned on said person's sternum, said second end will be positioned on a person's back and so that said transducer is pressed against said sternum with enough pressure to allow said vibrations to be transmitted to said person's rib cage without any interference from said movements of said person, a non-slip padding covers said second end of said band to keep said band from shifting on said person, a first hole is positioned at said first end of said band, a second hole is positioned in the center of said back of said clip, and a plug which is inserted through said first hole in said band and through said second hole in said back of said clip thus connecting said clip to said band and allowing said clip to rotate on said plug and allowing said transducer to better adjust itself to be able to lie flat against said person's sternum.

2. The bone conduction speaker and mounting system of claim 1 wherein said transducer is an inertial transducer.

3. The bone conduction speaker and mounting system of claim 2 wherein said inertial transducer vibrates in an audio frequency range of 4 Hz to 1000 Hz.

4. A bone conduction speaker and mounting system for allowing a person to feel an audible sound comprising:

a transducer for converting an electrical audio input signal into vibrations that vibrate in synchronism with the audio input signal, and mounting means for positioning said transducer against a person's sternum so that said transducer lies flat against said sternum with enough pressure and with enough dampening to allow said vibrations from said transducer to be transmitted to the person's rib cage without interference from any movements from said person and to cause said rib cage to resonate in synchronism with said vibrations from said transducer, said mounting means comprising:

a retaining ring which holds said transducer and which has two holes on opposite sides of said retaining ring, and a clip which has a top, a back and two front arms on either side of said clip where said back extends downwardly from said top, where said two front arms extend downwardly from said top and parallel to said back, and where said two front arms have pivot rods that slip into said holes on said opposite sides of said retaining ring so that said retaining ring can rotate on said pivot rods and can better adjust itself to be able to lie flat against said person's sternum;

a first belt which connects to a front area of a piece of clothing or to a front area of a second belt on said person and then passes over a shoulder of said person and connects to a rear area of said piece of clothing or to a rear area of said second belt on said person so that said two front arms and said back of said clip can slip over opposite sides of said first belt and can be moved up or down said first belt until said transducer is positioned over said person's sternum and so that said transducer is pressed against said sternum with enough pressure to allow said vibrations to be transmitted to said person's rib cage without any interference from said movements from said person.

5. The bone conduction speaker and mounting system of claim 4 wherein said transducer is an inertial transducer.

6. The bone conduction speaker and mounting system of claim 5 wherein said inertial transducer vibrates in an audio frequency range of 4 Hz to 1000 Hz.

* * * * *